US011516888B2

(12) United States Patent
Kim et al.

(10) Patent No.: US 11,516,888 B2
(45) Date of Patent: Nov. 29, 2022

(54) METHOD FOR MANUFACTURING FAR INFRARED HEATING WIRE AND FAR INFRARED HEATING WIRE MANUFACTURED THEREBY

(71) Applicants: Se Yeong Kim, Seoul (KR); Dong Woo Kim, Seoul (KR)

(72) Inventors: Se Yeong Kim, Seoul (KR); Dong Woo Kim, Seoul (KR)

( * ) Notice: Subject to any disclaimer, the term of this patent is extended or adjusted under 35 U.S.C. 154(b) by 946 days.

(21) Appl. No.: 16/328,255

(22) PCT Filed: Jul. 28, 2017

(86) PCT No.: PCT/KR2017/008134
§ 371 (c)(1),
(2) Date: Feb. 25, 2019

(87) PCT Pub. No.: WO2018/043922
PCT Pub. Date: Mar. 8, 2018

(65) Prior Publication Data

US 2019/0208576 A1 Jul. 4, 2019

(30) Foreign Application Priority Data

Aug. 31, 2016 (KR) ..... 10-2016-0111483

(51) Int. Cl.
*H05B 3/56* (2006.01)
*C22C 9/06* (2006.01)
(Continued)

(52) U.S. Cl.
CPC ..... *H05B 3/56* (2013.01); *C22C 9/06* (2013.01); *C22C 38/22* (2013.01); *H01B 7/0009* (2013.01);
(Continued)

(58) Field of Classification Search
CPC ..... H05B 3/56; H05B 3/0004; H05B 3/008; H05B 3/10; H05B 3/12; H05B 3/18;
(Continued)

(56) References Cited

U.S. PATENT DOCUMENTS

2010/0282458 A1* 11/2010 Ann ..... F24H 1/121 219/535
2017/0018331 A1* 1/2017 Hu ..... H01B 13/0036

FOREIGN PATENT DOCUMENTS

KR 20030077199 A1 10/2003
KR 100959070 B1 5/2010
(Continued)

OTHER PUBLICATIONS

International Search Report dated Nov. 8, 2017 in related PCT Application No. PCT/KR2017/008134.

*Primary Examiner* — Shawntina T Fuqua

(57) ABSTRACT

The present invention relates generally to a method of manufacturing far-infrared radiation thermal wire and far-infrared radiation thermal wire thereby, more particularly, a method of manufacturing far-infrared radiation thermal wire and far-infrared radiation thermal wire manufactured thereby, in which electric power is supplied with a predetermined resistance value.

According to an embodiment of the present invention, a method of manufacturing far-infrared radiation thermal wire comprise steps of: making microfine wire that emits far-infrared radiation as it generates heat according to the resistance value when electricity is flowed in; making one strand of thermal wire by bundling many strands of the microfine wire that are in contact of each other; and making two or more groups each of the groups having different resistance value and comprising one or more microfine wires that have identical resistance value in order to make the
(Continued)

bundle into an effective geometric structure that well radiates electric dipole radiation while emitting far-infrared radiation.

32 Claims, 1 Drawing Sheet

(51) Int. Cl.

| | |
|---|---|
| ***C22C 38/22*** | (2006.01) |
| ***H01B 7/00*** | (2006.01) |
| ***H01B 7/02*** | (2006.01) |
| ***H01B 13/00*** | (2006.01) |
| ***H01B 13/14*** | (2006.01) |
| *H05B 3/00* | (2006.01) |
| *H05B 3/10* | (2006.01) |
| *H05B 3/12* | (2006.01) |
| *H05B 3/18* | (2006.01) |
| *H01B 1/02* | (2006.01) |

(52) U.S. Cl.
CPC ..... *H01B 7/0275* (2013.01); *H01B 13/0036* (2013.01); *H01B 13/14* (2013.01); *H01B 1/026* (2013.01); *H05B 3/0004* (2013.01); *H05B 3/008* (2013.01); *H05B 3/10* (2013.01); *H05B 3/12* (2013.01); *H05B 3/18* (2013.01); *H05B 2203/017* (2013.01); *H05B 2203/032* (2013.01)

(58) Field of Classification Search
CPC .... H05B 3/145; H05B 3/82; H05B 2203/017; H05B 2203/032; C22C 9/06; C22C 38/22; H01B 7/0009; H01B 7/0275; H01B 7/428; H01B 13/0036; H01B 13/14; H01B 13/01209; H01B 1/026
See application file for complete search history.

(56) References Cited

FOREIGN PATENT DOCUMENTS

| | | | |
|---|---|---|---|
| KR | 100969323 | B1 | 7/2010 |
| KR | 20110088142 | A | 8/2011 |
| KR | 101549344 | B1 | 9/2015 |

* cited by examiner

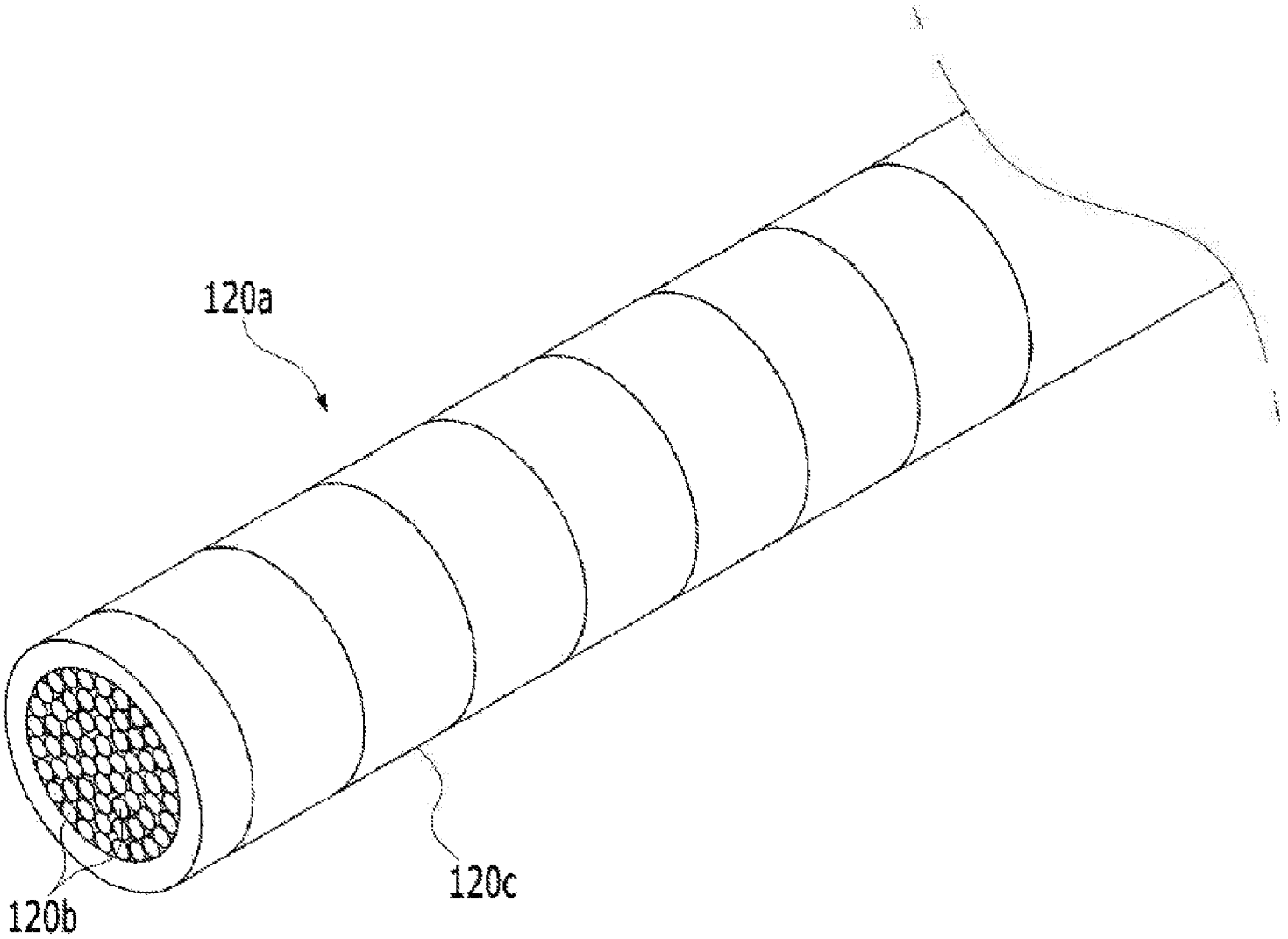
120a
120c
120b

METHOD FOR MANUFACTURING FAR INFRARED HEATING WIRE AND FAR INFRARED HEATING WIRE MANUFACTURED THEREBY

TECHNICAL FIELD

The present invention relates generally to a method of manufacturing a far-infrared radiation thermal wire, more particularly, a method of manufacturing a thermal wire with a predetermined resistance value that emits far-infrared radiation when electricity is flowed in.

BACKGROUND ART

As Korea is one of many with limited natural resources, energy conservation is an essential assignment, and future of energy conservation is becoming a greater issue.

To conserve energy, an inefficient structure must primarily improve, and by improving the energy inefficient structure, the field where energy is consumed to produce heat benefits the most from the energy conserving effect.

To surely obtain such energy conservation effect to its full extent, method of heating (method of generating and delivering heat), which is used to obtain heat at heat-needed places, must be changed to a high efficient method of heating that conserves energy.

Of all, the field of generating heat consumes the most energy. The particularly important technology of energy conservation must come from a revolutionary shift in the paradigm of generating and delivering heat.

In current drying facilities, residential construction culture and industrial fields all over the world, the method of generating and transmitting heat still depends on the method of heat conduction or convection.

That is because, of all heating methods of convection, conduction, and radiation, conduction and convection heating methods share similar heating efficiency compared to its energy consumption and low energy efficiency and radiant heating method via far-infrared radiation directly transfers heat and, thus, has high energy efficiency compared to its energy consumption.

As inferred in winter, where sunlight feels warm at 20° C. because of such energy efficient characteristic but conduction heat of water at 20° C. does not feel warm, the heating method via heat radiation of far-infrared radiation, such as the sunlight, is much more effectively applied to the sensation of heat that our bodies feel.

Accordingly, radiant heating via far-infrared radiation is high in heat efficiency compared to heating via conduction or convection, the most high effective heat transfer method technology, and the technology that will lead a revolutionary shift in paradigm of the heat market for the future humanity to conserve most energy in heat generation and consumption.

However, as overall industry uses traditional heating element and methods of convection and conduction to heat, why is the high energy efficient technology of radiant heating via far-infrared radiation not being utilized?

The reason is that there isn't a technology that could materialize actual radiant heating (highly efficient energy conserving heating) via true far-infrared radiation, like the one from sunlight.

In order to materialize actual radiant heating (highly efficient energy conserving heating) via true far-infrared radiation, far-infrared radiation that is emitted from heating of electric heating element, like the far-infrared radiation of the sun, must travel a long distance, have good absorbance (transmittance rate), and have a good heat conversion rate via resonance after being absorbed.

However, current radiant heating element that supposedly emits heat radiation and supplies far-infrared radiation (i.e. heating element that contains carbon) has a short travel distance (within 1.5 m) of radiant heating via far-infrared radiation, a minimal transmittance rate (absorbance rate) that cannot even transmit over a sheet of standard fabric, and a weak heat conversion rate after being absorbed.

Accordingly, actual radiant heating (highly efficient energy conserving heating) cannot be materialized.

For example, another important factor in places, where it is necessary to uniformly heat the entirety of a large space, such as industrial drying facilities, is that heating must be sufficient regardless of the size that needs to be heated, and it should be able to uniformly heat the whole space.

However, conventional heating technologies have made heating in large spaces almost impossible.

In other words, in a space with a large area, only the surrounding area of the heater (conductive heat) is hot, but a little distant area is cold. There is a limitation even with blowing hot air (convection heat) when blowing the entirety of a large space.

Also, the heating condition was not uniform in the entire space.

In other words, the area of the heater is hot but distant area is cold and, the area where the hot wind reaches is hot but cold in area where it does not reach.

For example, in a drying facility that dries seafood, while there should be a larger area for dried seafood than for the heating equipment, if only the drying compartment near the heating equipment is warmly heated and afar from the heating equipment is not heated and kept cold, only the nearby seafood will dry, Further, the seafood in immediate proximity will have too less moisture and be in a poor quality as a product. The seafood faraway will not dry well or have too much moisture even if a little dries and be in a poor quality as a product.

In general, current heating technology of heating elements that heat by conduction or convection or recently supplied heating technology of claimed-to-be far-infrared radiation is too inefficient and consumes high in energy that it is difficult to outcompete fossil fuels in obtaining the heat for drying in drying facilities. As it is not economical to utilize as an electric heating element to generate various kinds of heat and to be in various facilities, equipments, or machines, the area of application was very limited.

DISCLOSURE OF THE INVENTION

Technical Problem

The purpose of the invention is to provide a method of manufacturing far-infrared radiation thermal wire and such thermal wire to solve above-stated problems. As a technology that radiantly heats via emission of real far-infrared radiation, like the far-infrared ray of the sunlight, the present invention can materialize the heating technology of ultra-highly efficient energy conservation heating that can outcompete the conventional fossil fuels with conventional electricity (AC electricity supplied from a power plant) and can heat with high energy saving efficiency by directly using solar-powered electricity and zeroing electricity (free electricity) of heating energy via true far-infrared radiation.

Another purpose of the present invention is to provide an energy saving effect, and able large space heating via radiant heating that has not been materialized due to technical limitations. Particularly, a facility, equipment, or machine that can rapidly generate high heat or ultra-high heat by directly using solar-powered electricity and generate and deliver diverse heat in fields that need heat. The purpose of the present invention is to provide a method of manufacturing far-infrared radiation thermal wire to establish a thermal revolution.

And, another purpose of the present invention is to outcompete the use of fossil fuel in places where generation of heat is needed and replace with heating via electricity and to delay the progression of climate change. The purpose of the present invention is to provide a method of manufacturing far-infrared radiation thermal wire.

SUMMARY OF THE INVENTION

In order to achieve above purposes, a method of manufacturing far-infrared radiation thermal wire comprise steps of: making microfine wire that emits far-infrared radiation as it generates heat according to the resistance value when electricity is flowed in; making one strand of thermal wire by bundling many strands of the microfine wire that are in contact of each other; and making two or more groups each of the groups having different resistance value and comprising one or more microfine wires that have identical resistance value in order to make the bundle into an effective geometric structure that well radiates electric dipole radiation while emitting far-infrared radiation.

The microfine wire is made of material that emit a large amount of far-infrared radiation by the dipole moment occurred when electricity flows in.

Two or more groups have different heat generating functions, are made of different materials, or have different thicknesses while each group comprises one or more microfine wires with identical resistance value in order to differentiate resistance values of each group.

The method of manufacturing far-infrared radiation thermal wire further comprise one or both steps of changing (adjusting) the number of strands of the bundle's microfine wire; or changing (adjusting) the self-heating temperature of the bundle, to effectively control the far-infrared radiation emission.

The step of changing (adjusting) the number of strands of the bundle's is accomplished by changing (adjusting) the number of strands of the bundle's while having one or more identical conditions of the resistance value, material, or thickness of the microfine wire to control the amount of far-infrared radiation.

The step of changing (adjusting) the number of strands of the bundle's while having one or more identical conditions of the resistance value, material, or thickness of the microfine wire is controlling the number of microfine wire strands while keeping the combined resistance value per unit length of one bundle (thermal wire) the same.

The step of changing (adjusting) the number of strands of the bundle's microfine wire is controlling the number of microfine wire strands within each group while the combined resistance value per unit length of one bundle (thermal wire) is identical in a state of multiple groups each comprising of multiple strands of microfine wire having the identical resistance value or the material.

The step of changing (adjusting) the self-heating temperature of the bundle is chaing the self-heating temperature within a range of 80° C. to 600° C.

The step of changing (adjusting) the self-heating temperature of the bundle is changing the total composite resistance value of the bundle's multiple microfine wire strands to adjust to the bundle's specific resistance value per unit length.

The step of changing the total composite resistance value of multiple microfine wire strands is one or more methods selected from a group consisting of;

the first method, changing the microfine wire's total number of strands while keeping the material and the thickness of microfine wire's multiple strands identical;

the second method, changing the microfine wire's thickness while keeping the material and the number of microfine wire's multiple strands identical;

the third method, changing the microfine wire's material while keeping the thickness and the number of microfine wire's multiple strands identical;

the fourth method, changing the material of the microfine wires within each group uniformly after forming two or more groups of different material while keeping the thickness and number of microfine wire's multiple strands identical;

the fifth method, changing the number of microfine wire strands within each group after forming two or more groups of different material while keeping the thickness of microfine wire's multiple strands identical;

the sixth method, changing the thickness of microfine wires within each group after forming two or more groups of different material while keeping each group's or bundle's total number of multiple microfine wire strands identical; and the seventh method, changing the thickness and number of multiple microfine wire strands within each group after forming two or more groups of different material.

The seventh method is characterized by any one method of;

changing microfine wire's thickness and number of strands in Group 1 while the group's material is identical, and making the Group 2's material and microfine wire's thickness and number of strands identical while the group's material is different from the first group;

changing microfine wire's thickness and number of strands in Group 1 while the group's material is identical, and changing the number of strands in Group 2 while the group's material and microfine wire's thickness are identical and the group's material is different from the first group; or changing microfine wire's thickness and number of strands in Group 1 while the group's material is identical, and changing the thickness in Group 1 while the group's material and microfine wire's number of strands are identical and the group's material is different from the first group.

The material of the microfine wire is a single metal or an alloy.

The material of the single metal is copper.

The alloy metal is made of any one or more of; SUS 316 as an alloy metal of stainless steel series, steel fiber (metal fiber) (NASLON); an alloy of nickel and copper made from a mixing ratio of nickel 20-25% by weight, copper 75-80% by weight; or an alloy made of iron 68-73% by weight, chromium 18-22% by weight, alumina 5-6% by weight, molybdenum 3-4% by weight.

Silicon, manganese, and carbon are added into the alloy made of iron 68-73% by weight, chromium 18-22% by weight, alumina 5-6% by weight, molybdenum 3-4% by weight.

The microfine wire is made by any one or more of;

making a single metal or an alloy metal as a fine metal filament through a drawing machine and using it as the microfine wire; making the single metal or the alloy metal as a metal spun yarn through a spinning machine and using it as the microfine wire; or using a steel fiber (metal fiber) (NASLON) as the microfine wire in order for the microfine wires to have a uniform resistance value as a whole.

The bundle is made by any one or more of;

the first method, wrapping and coating microfine wires with high-temperature fibers along the longitudinal direction, the second method, twisting itself to become a single body through a double twister, the third method, coating and pulling out through a coating machine, the fourth method, repeating the third method two or more times, the fifth method, using a different material of coating per each coating from the fourth method, the sixth method, coating and pulling out the product of the first or the second method once or more through the coating machine, the seventh method, coating the product of the first or the second method once or more with identical coating material per coating, identical coating material per a part of coating and different coating material per a part of coating, and different coating material per coating through a coating machine, and the eight method, placing an adhesive between upper and lower plates of plated material and melting the adhesive.

The high-temperature fiber used in the first method is aramid, polyarylate, or zyron.

The coating material used in the third and the seventh methods is teflon, PVC, or silicon.

A far-infrared radiation thermal wire comprise:

a bundle of the thermal wires which is in a parallel composite structure, where proximate multiple strands of microfine wire compile together as they emit far-infrared radiation while generating heat according to their resistance value when electricity is flowed in;

wherein the bundle is in a geometric structure, which emits electric dipole radiation of far-infrared ray while having different numbers of microfine wire strands when the multiple strands of microfine wire have one or more of the identical resistance value, material, or thickness.

The microfine wire is made of a material that emits a large amount of far-infrared radiation with a dipole moment when electricity flows in.

A far-infrared radiation thermal wire comprise:

a bundle of the thermal wires which is in a parallel composite structure, where proximate multiple strands of microfine wire compile together as they emit far-infrared radiation while generating heat according to their resistance value when electricity is flowed in;

wherein the bundle is in a geometric structure emitting electric dipole radiation of far-infrared ray, which has two or more groups with different resistance value while each of the groups is formed of one or two strands of microfine wire that has an uniform resistance value.

Two or more groups of different resistance value comprise any one or more of; two or more groups of different material; two or more groups of different heat generating function; and two or more groups of different thickness.

Two or more groups are comprised of one or more identical strands within each group.

The bundle only generates heat when the bundle is within a temperature range of 80° C. to 600° C.

The material of the microfine wire is a single metal or an alloy metal.

The material of the single metal is copper.

The alloy metal is made of any one or more of; SUS 316 as an alloy metal of stainless steel series; steel fiber (metal fiber) (NASLON); an alloy of nickel and copper made from a mixing ratio of nickel 20-25% by weight, copper 75-80% by weight; or an alloy made of iron 68-73% by weight, chromium 18-22% by weight, alumina 5-6% by weight, molybdenum 3-4% of weight.

Silicon, manganese, and carbon are added into the metal alloy made of iron 68-73% by weight, chromium 18-22% by weight, alumina 5-6% by weight, molybdenum 3-4% by weight.

A far-infrared radiation thermal wire comprise:

a bundle of the thermal wires which is in a parallel composite structure, where proximate multiple strands of microfine wire compile together as they emit far-infrared radiation while generating heat according to their resistance value when electricity is flowed in;

wherein the thermal wires are made of two kinds of material with identical thickness of microfine wires for each material but different thickness and number of strands between each material;

wherein one material comprise 550 strands of 12 μm thick microfine wire, being SUS 316 or steel fiber NASLON; and the other material comprise 24 strands of 100 μm thick (resistance-value of 36Ω per one strand) microfine wire, being a single metal of nickel and copper with a mixing ratio of 20-25% nickel by weight and 75-80% copper by weight;

wherein the strands of two materials are bundled into one and the bundle have the resistance value per 1 m length of the thermal wire as 1.37Ω.

A far-infrared radiation thermal wire comprise:

a bundle of the thermal wires which is in a parallel composite structure, where proximate multiple strands of microfine wire compile together as they emit far-infrared radiation while generating heat according to their resistance value when electricity is flowed in;

wherein the thermal wires are made of two kinds of material with identical thickness of microfine wires for each material but different thickness and number of strands between each material;

wherein one material comprise 550 strands of 12 μm thick microfine wire with, being SUS 316 or steel fiber NASLON; and the other material comprise 14 strands of 100 μm thick (resistance-value of 36Ω per one strand) microfine, being a single metal of nickel and copper with a mixing ratio of 20-25% nickel by weight and 75-80% copper by weight;

wherein the strands of the two materials are bundled into one and the bundle have the resistance value per 1 m length of the thermal wire as 2.15Ω.

A far-infrared radiation thermal wire comprise:

a bundle of the thermal wires which is in a parallel composite structure, where proximate multiple strands of microfine wire compile together as they emit far-infrared radiation while generating heat according to their resistance value when electricity is flowed in;

wherein the thermal wires are made of two kinds of material with identical thickness of microfine wires for each material but different thickness and number of strands between each material;

wherein one material comprise 550 strands of 12 μm thick microfine wire, being SUS 316 or steel fiber NASLON; and the other material comprise 9 strands of 100 μm thick (resistance-value of 36Ω per one strand) microfine wire, being a single metal of nickel and copper with a mixing ratio of 20-25% nickel by weight and 75-80% copper by weight;

wherein the strands of the two materials are bundled into one and the bundle have the resistance value per 1 m length of the thermal wire as 3.12Ω.

A far-infrared radiation thermal wire comprise:

a bundle of the thermal wires which is in a parallel composite structure, where proximate multiple strands of microfine wire compile together as they emit far-infrared radiation while generating heat according to their resistance value when electricity is flowed in;

wherein the thermal wires are made of two groups with two kinds of material with identical material of microfine wires for each group but different material and number of strands among each material;

wherein material 1 of group 1 comprise 1,100 strands of 12 μm thick microfine wire, being SUS 316 or steel fiber NASLON; and material 2 of group 2 comprise 45 strands of 180 μm thick microfine wire, being a single metal of nickel and copper with a mixing ratio of 20-25% nickel by weight and 75-80% copper by weight;

wherein the strands of the two groups are bundled into one and the bundle have the resistance value per 1 m length of the thermal wire as 0.495Ω.

A far-infrared radiation thermal wire comprise:

a bundle of the thermal wires which is in a parallel composite structure, where proximate multiple strands of microfine wire compile together as they emit far-infrared radiation while generating heat according to their resistance value when electricity is flowed in;

wherein the thermal wires are made of three groups with three kinds of material with identical material of microfine wires for each group but different material and number of strands among each material;

wherein material 1 of group 1 comprise 1,100 strands of 12 μm thick microfine wire, being SUS 316 or steel fiber NASLON; material 2 of group 2 comprise 9 strands of 180 μm thick microfine wire, being a single metal of nickel and copper with a mixing ratio of 20-25% nickel by weight and 75-80% copper by weight; and material 3 of group 3 comprise 2 strands of 140 μm thick microfine wire, being a single metal of copper;

wherein the strands of three groups are bundled into one and the bundle have the resistance value per 1 m length of the thermal wire as 0.314Ω.

A far-infrared radiation thermal wire comprise:

a bundle of the thermal wires which is in a parallel composite structure, where proximate multiple strands of microfine wire compile together as they emit far-infrared radiation while generating heat according to their resistance value when electricity is flowed in;

wherein the thermal wires are made of three groups with three kinds of material with identical material of microfine wires for each group but different material and number of strands among each material;

wherein material 1 of group 1 comprise 1,100 strands of 12 μm thick microfine wire, being SUS 316 or steel fiber NASLON; material 2 of group 2 comprise 9 strands of 180 μm thick microfine wire, being a single metal of nickel and copper with a mixing ratio of 20-25% nickel by weight and 75-80% copper by weight; and material 3 of group 3 comprise 3 strands of 140 μm thick microfine wire, being a single metal of copper;

wherein the strands of three groups are bundled into one and the bundle have the resistance value per 1 m length of the thermal wire as 0.202Ω.

A far-infrared radiation thermal wire comprise:

a bundle of the thermal wires which is in a parallel composite structure, where proximate multiple strands of microfine wire compile together as they emit far-infrared radiation while generating heat according to their resistance value when electricity is flowed in;

wherein the thermal wires are made of one kind of material with identical thickness but different number of strands;

wherein material comprise 550 strands of 12 μm thick microfine wire, being SUS 316 or steel fiber NASLON;

wherein the 550 strands are bundled into one and the bundle have the resistance value per 1 m length of the thermal wire as 14Ω.

A far-infrared radiation thermal wire comprise:

a bundle of the thermal wires which is in a parallel composite structure, where proximate multiple strands of microfine wire compile together as they emit far-infrared radiation while generating heat according to their resistance value when electricity is flowed in;

wherein the thermal wires are made of one kind of material with identical thickness but different number of strands;

wherein material comprise 1,100 strands of 12 μm thick microfine wire, being SUS 316 or steel fiber NASLON;

wherein the 1,100 strands are bundled into one and the bundle have the resistance value per 1 m length of the thermal wire as 7Ω.

Advantageous Effects

According to above-described present invention, as a technology that radiantly heats via emission of real far-infrared radiation, like the far-infrared radiation of the sun, it can materialize the technology of ultra-highly efficient energy conservation heating that can outcompete conventional fossil fuels with conventional electricity (AC electricity supplied from a power plant) and can heat with high energy saving efficiency by directly using solar-powered electricity and zeroing electricity (free electricity) of heating energy via true far-infrared radiation.

Its energy saving effect is remarkable. It can heat large spaces via radiant heating that has not been materialized due to technical limitations. In particular, it can establish a heat revolution from a facility, equipment, or machine that can rapidly generate high heat or ultra-high heat by directly using solar-powered electricity and deliver diverse heat in fields that need heat.

It can outcompete the use of fossil fuel in places where generation of heat is need and replace with heating via electricity. It can lead reduction of earth's carbon emission and other pollutants (find dust in the atmosphere, etc.). It can delay the further progression of climate change.

BRIEF DESCRIPTION OF THE DRAWINGS

FIG. 1 is an example of the far-infrared radiation thermal wire according to an embodiment of the present invention.

EMBODIMENTS

Embodiment 1

FIG. 1 is an example of the far-infrared radiation thermal wire made according to the embodiment of present invention.

As shown in FIG. 1, the far-infrared radiation thermal wire (120*a*), according to invention's embodiment, has a small amount of a resistance value, creates a microfine wire (120*b*) that emits far-infrared radiation when electricity is flowed in, and is composed of one strand of a thermal wire that is made from bundling of contacting multiple microfine wire strands (120*b*).

The following is a detailed description of the method of making a far-infrared thermal wire (120*a*) of embodiment 1 and FIG. 1.

If desired to significantly conserve energy from every place in the world where heat generation is needed, the desired heat must be radiantly heated while emitting far-infrared radiation.

All heating methods of convection, conduction, and radiation, conduction and convection heating methods share similar heating efficiency compared to its energy consumption and low energy efficiency and radiant heating method via far-infrared radiation directly transfers heat and, thus, has high energy efficiency compared to its energy consumption.

As inferred in winter, where sunlight feels warm at 20° C. because of such energy efficient characteristic but conduction heat of water at 20° C. does not feel warm, the heating method via heat radiation of far-infrared radiation, such as the sunlight, is much more effectively applied to the sensation of heat that our bodies feel.

Such radiant heating technology generates and delivers heat by causing vibrations (resonance) inside of the substance and returning the electric energy into heat again after the electric energy flies out of the heating element (thermal wire) in a speed of light. The electric energy further becomes absorbed into the substance as the energy changes to the wavelength of light (far-infrared ray) when the heating element consumes 1 kw of electricity, The heat efficiency of such radiant heating technology varies greatly depending on how efficiently the electric energy is changed (magnitude, efficiency) into the wavelengths of light (far-infrared ray), how far such changed wavelengths of light (far-infrared ray) can travel (magnitude, efficiency), how well the wavelengths of light (far-infrared radiation) is absorbed (magnitude, efficiency) into the substance, and how much of the wavelengths of light (far-infrared ray) is returned (magnitude, efficiency) back to heat after the wavelengths of light is absorbed into the substance.

And degree of far-infrared radiation activation refers to most efficient method of materializing such wavelengths (far-infrared ray) and actions (magnitude, efficiency) of light, The wavelengths of light that best activates far-infrared radiation are far-infrared ray that directly comes from the sun. A larger heat effect can be produced as such method of heating directly transfers the heat when heating via radiant heating and far-infrared radiation emission.

Therefore, if the thermal wire that can emit far-infrared radiation is developed, applied, and used in all facilities that generate and deliver heat in all the places heat is desired, it will lead to a paradigm shift of a heat generating and delivering technology in aspects of future energy conservation. It will lead a heat revolution.

In conclusion, the method of developing the most effective thermal wire that emits far-infrared radiation is making one strand of thermal wire by bundling multiple strands of microfine wires that are in contact of each other into one after making microfine wire that emits far-infrared radiation with small resistance value when electricity is flowed in.

To more thoroughly explain the method of manufacturing a thermal wire that can emit far-infrared radiation from a result of experimenting with made samples in a laboratory for emission of far-infrared radiation from a thermal wire, ① It must be in a geometric structure that can better radiate electric dipole radiation, where the far-infrared radiation is emitted from a thermal wire, ② The above thermal wire should be made of a material that largely emits far-infrared radiation (In particular, it should be a material that allows a dipole moment when electricity flows).

Embodiment 1-1

Describes ① of above embodiment 1: a method of having a geometric structure that can better radiate electric dipole radiation, where the far-infrared radiation is emitted from a thermal wire.

First, electric dipole radiation refers to radiating electromagnetic wave that emits electric dipole whose magnitudes change with time, such radiating electromagnetic wave is far-infrared ray and, when it is transformed into far-infrared radiation, emits large amounts of far-infrared radiation as radiation becomes larger.

Therefore, it is necessary to artificially maintain the change of electric dipole each every moment, and an effective method, identified as a result of countless experiments conducted in a laboratory with created samples among many methods, is a method that can constantly maintain and repeat the occurrence of the temperature change effect from the materials constituting the thermal wire with each other at time ΔT.

In order to explain this in more detail, assume that 10 thermal wires having the same resistance value are spaced apart at regular intervals and combined. Although the thermal wires are in thermal equilibrium as each thermal wire transmits the heat generated by its body to each other and receives the heat from other when electricity flows into 10 thermal wires simultaneously, the thermal equilibrium is converged as it constantly repeats to have and not to have a microscopic difference in the minute inner state.

Observing such state more microscopically, while 10 thermal wires with the same resistance value generate heat at an identical temperature and transmit heat to each other at instances, they cool off their own heating temperature when it transmits heat, thereby a very minute change of temperature occurs more than a thousand times a second to raise its own heating temperature when receiving heat.

When the temperature change is made at such ΔT time, assume that the material of the thermal wire is composed of a material that can create dipole moment when electricity flows. Such material emits far-infrared radiation when electric dipole radiation occurs as the change in magnitude of dipole moment occurs constantly, while the one directional distortion of the electron flow repeats to enlarge, diminish, and disappear when change in temperature occurs, especially when it frequently changes minutely.

When the temperature change effect is further intensified, the radiation enlarges and, as it becomes converted to far-infrared radiation at this time, emits itself out of the thermal wire in large amounts more strongly.

Based on these results, the geometric structure of the thermal wire should be made to allow such minute heat change effect.

In a conventional manufacturing method, minute heat change effect does not occur very frequently as the thermal wire, being one whole body, does not have to transmit or receive heat from each other when heat is generated with electricity flowed into a container made of one cross-sectional area of a thermal wire having a small amount of a resistance value.

However, if the composite resistance value is identical as the value of one cross-sectional area after combining multiple microfine cross-sectional areas, which are internally divided from multiple strands of microfine wire, the body of internal thermal wire is not of a single body but of multiple bodies while there is no difference in the resistance value. Thereby, the temperature change effect is continuously maintained within the material of the thermal wire itself at time ΔT according to above principal.

In conclusion, in order to emit far-infrared radiation more effectively, the geometric structure of the thermal wire that generates electric dipole radiation in constantly changing magnitude of the dipole moment and effectively emits large amount of far-infrared radiation by amplifying such electric dipole radiation must be manufactured.

This method (technique) is most effective when the geometric structure of the thermal wire that allows single bundling of multiple strands of above microfine wire in contact of each other after manufacturing a microfine wire with a small resistance value that emits far-infrared radiation when electricity is flowed in is formed.

Embodiment 1-2

Describes ② of above embodiment 1: above thermal wire should be made of a material that largely emits far-infrared radiation (In particular, it should be a material that allows a dipole moment when electricity flows).

As a result of experiments conducted in a laboratory with created samples, a more effective material for the thermal wire that emits a large amount of far-infrared radiation when a dipole moment forms with electricity flowing in is a single metal or an alloy metal.

A more detailed example of this is further described in Embodiment 4-1.

Embodiment 2

As described above in Embodiment 1-1, while the radiation enlarges when the temperature change effect is further intensified and, converted to a far-infrared radiation at this time, is more largely and strongly emitted out of the thermal wire, The following describes a such method that can further deepen the temperature change effect at ΔT time.

Combining multiple strands of microfine wire into one bundle and using the strand of thermal wire (bundle), use two or more groups of microfine wires that each have different resistance values per each group after dividing them within a bundle into two or more groups as one body of a bundle.

For example, divide the content of first strand of the bundle into three groups, Compose the first group with multiple strands of microfine wire of a material that has a high resistance value, the second group with multiple strands of microfine wire of a material that has a mid-resistance value, and the third group with multiple strands of microfine wire of a material that has a low resistance value. Synthesize all three groups and create one bundle.

When electricity is supplied to the bundle made in this manner, the first group generates a slight heat with electricity as it has a high resistance value, the second group generates mediocre amount of heat with the electricity as it has a mid-resistance value, and the third group generates high heat with the electricity as it has a low resistance value.

Because the constant convergence process is progressed in a heat equilibrium as groups more intensely repeat to give and receive heat from each other to overcome an enlarged difference of each group's temperature, the rate and effect of heat change much greatly intensifies at ΔT time with intensification of heat difference in each of three groups compared to composing multiple strands of microfine wire within the single bundle with a material that generates identical heat.

In conclusion, the temperature change effect can be further intensified if one bundle (thermal wire), of thermal wires where one bundle (thermal wire) is made of multiple strands of microfine wire, is composed in two or more groups each having different resistance value while multiple strands of microfine wire within each group internally have identical resistance values.

Further, as a more effective method of making the resistance value of each group different, compose two or more groups that each has different heat generating functions, different materials, or different thickness and manufacture in two or more methods among above methods. If each different group's inner compartment is composed of identical multiple microfine wire strands, the resistance value of each group may be more effectively differentiated, thereby this method can further intensify the temperature change effect.

And when such temperature change effect is further intensified, the far-infrared ray enlarges and, as it is converted to far-infrared radiation, emits far-infrared radiation more strongly in greater amounts.

The thermal wire that most effectively expresses this function, made by above manufacturing method, is further described in later Embodiment 5-1 or Embodiment 5-6.

Embodiment 3

The embodiment explains the method of adjusting the emission effect of far-infrared ray (the amount of far-infrared radiation emitted) when the bundle (thermal wire) emits far-infrared radiation according to above Embodiment 1 and Embodiment 2.

As a more effective method to control the emission effect of far infrared radiation, ① A method of changing (controlling) the number of microfine wire strands in a thermal wire, which is a bundle of synthesized multiple strands of microfine wires in above Embodiment 1 and Embodiment 2, ② A method of controlling the bundle's (thermal wire) heat generating temperature itself in the thermal wire that bundled multiple strands of microfine wires in above Embodiment 1 and Embodiment 2, ③ A method of combining above methods of ① and ②, where the number of microfine wire strands and the heat generating temperature of a bundle (thermal wire) are controlled at the same time.

Embodiment 3-1

The following describes ① of above embodiment 3: a method of changing (controlling) the number of microfine wire strands in a thermal wire, which is a bundle of synthesized multiple strands of microfine wires in above Embodiment 1 and Embodiment 2.

Assuming the microfine wire is composed of a single or an alloy metal with small resistance value when electricity flows and emits far-infrared radiation, Supposing the first method is even spacing and synthesis of 10 microfine wires that have an identical resistance value, Supposing the second method is even spacing and synthesis of 10 microfine wires that have an identical resistance value, Assuming the composite resistance values of 10 microfine thermal wires of the first method and 20 microfine thermal wires of the second method are made identical, Although the thermal wires are in thermal equilibrium as each thermal wire transmits the heat generated by its body to each other and receives the heat from other strands when electricity flows into 10 and 20 thermal wires simultaneously, the thermal equilibrium is converged as it constantly repeats to have and not to have a microscopic difference in the minute inner state.

Observing Such State More Microscopically,

While 10 microfine thermal wires of the first method and 20 microfine thermal wires of the second method generate heat at an identical temperature and transmit heat to each other at instances, they cool off their own heating temperature when it transmits heat, thereby a very minute change of temperature occurs more than a thousand times a second to raise its own heating temperature when receiving heat.

Observed in detail, the temperature change occurs more frequently at ΔT time in 20 microfine thermal wires of the second method compared to 10 microfine thermal wires of the first method, Because there is twice as much as an element that generates heat with 20 thermal wires compared to 10 thermal wires, which causes greater changes in temperature within the ΔT time as number (amount) of heat exchanges made among thermal wires naturally increase.

Further, if it becomes possible to create more temperature changes within the ΔT time, as described above in Embodiment 1-1, the radiation enlarges and, as it converts itself to far-infrared radiation, emits out of the thermal wire more effectively in greater amount when such temperature change effect intensifies, Thereby synthesis of 20 microfine thermal wires of the second method emits greater amount of far-infrared radiation compared to synthesis of 10 microfine thermal wires of the first method.

In conclusion, the method (technology) of controlling the emission effect of far-infrared radiation can control the amount of far-infrared radiation emitted from a thermal wire, which is a bundle of multiple microfine wire strands with identical conditions, by adjusting (controlling) the number of microfine wire strands.

To explain the method of changing (controlling) the number of microfine wire strands within a thermal wire that is created from bundling of those multiple microfine wire strands with identical conditions in a more broken down manner, ① method of controlling the number of microfine wire strands of the thermal wire, which is the bundle that is created from bundling of multiple microfine wire strands with identical conditions, while keeping each bundle's (thermal wire) composite resistance value per unit length identical, ② A method of controlling the number of microfine wire strands of the thermal wire, which is the bundle that is created from grouping multiple strands of the microfine wire with identical material or resistance value into two or more multiple groups, within each respective group (standardizing or differentiating each group) while keeping each bundle's (thermal wire) composite resistance value per unit length identical.

Here, the identical condition of the microfine wire refers to having any one or more of the resistance value, material, or thickness identical.

Embodiment 3-2

The following describes ② of above embodiment 3: a method of controlling the bundle's (thermal wire) heat generating temperature itself in the thermal wire that bundled multiple strands of microfine wires in above Embodiment 1 and Embodiment 2.

As molecules (atoms) of all matter always inherently vibrate within their own natural vibration width (radius) at a constant temperature, the molecule's natural vibration width enlarges when heat increases.

On the other hand, while all atoms are internally composed of elementary particles, fine particles, neutrons, and protons, such nucleons always each rotate in a fixed direction with their own natural cycle and have a fixed amount of momentum.

The sum of the momentum of these nucleons is called nuclear-spin, and such nuclear-spin increases proportionally as the natural vibration width of the atoms increases.

As a result of an experiment with manufactured samples in a laboratory, the size of the energy contained in the thermal wire manufactured according to above embodiments 1 through 3-2 further enlarges when the size of the nuclear-spin increases.

Therefore, the size of nuclear-spin of atoms that compose the inner microfine wire strands determine how effectively the far-infrared radiation's effect, such as the far-infrared radiation from the sun, adjusts (magnitude, efficiency), how far the adjusted wavelengths of light (far-infrared ray) travels (magnitude, efficiency, how well the wavelengths of light (far-infrared ray) is absorbed (magnitude, efficiency) into a material, and how much of the wavelength of light is converted (magnitude, efficiency) back into heat after it has been absorbed.

Therefore, if the heat generating temperature of the bundle itself, when manufactured according to embodiments 1 through 3-2, is raised, the nuclear-spin of atoms that compose the thermal wire increases. Then, the energy possessed by the far-infrared radiation emitted from the thermal wire increases while increase in heating temperature of the bundle (thermal wire) further contributes in increase of the energy. Thereby, such controlling of the bundle's (thermal wire) heating temperature is a method (technology) of controlling the size of the energy.

The size of energy that the emitted far-infrared radiation possesses is not simply, directly proportional to the degree of increase in bundle's heating temperature. The size of the energy most effectively increases directly proportional to the increase in the heating temperature when the bundle's (thermal wire) heating temperature is within the range of 80° C. to 600° C. The possession of the energy drastically decreased or did not exist below 80° C. or above 600° C.

In conclusion, after making a microfine wire that emits far-infrared radiation with small resistance value when electricity is flowed in and one strand of thermal wire by bundling multiple strands of microfine wires that are in contact of each other into one, control the size of energy that the emitted far-infrared radiation possesses by controlling the heat generating temperature of the bundle (thermal wire). It is most effective when the controlling temperature is within the range of 80° C. to 600° C.

Embodiment 3-2-1

The following describes a method of controlling the bundle's (thermal wire) heat generating temperature to materialize above technology of Embodiment 3-2.

In order to generate heat to maintain a desired uniform temperature for a bundle's (thermal wire) heating temperature, the bundle (thermal wire) needs to consume electric power for such heating temperature.

That is, the amount of heat generated to generate the desired temperature is directly proportional to the amount of electric power flowed into the bundle (thermal wire).

And, P (power)=V (voltage)×I (current), R (resistance value=composite resistance value)=V (Voltage)÷I (current), I (amount of current flowing through the bundle (thermal wire))=V (voltage)÷R (The resistance value of the thermal wire).

While a standard data must be collected through experiments to determine the amount of electric power consumed by the bundle (thermal wire) to generate a certain heat generating temperature, For example, as a standard experimental data obtained from the experiment that used certain characteristics of a bundle (thermal wire) manufactured according to above Embodiments 1 through 3-2, With the electric power consumption of about 15.5 W per 1 m of a bundle (thermal wire), the bundle (thermal wire) generates heat at about 100° C. (maximum temperature, with an error range of ±20%, when measured in heat equilibrium achieved by thermal storage).

It generates heat at 150° C. (error range±20%) with an electric power consumption of about 22 W per 1 m, It generates heat at 230° C. (error range±20%) with an electric power consumption of about 38 W per 1 m, It generates heat at 600° C. (error range±20%) with an electric power consumption of about 100 W per 1 m.

Since the electric power equipment in connection with the bundle (thermal wire) or the to-be-used electricity uses voltage that is determined in advance, the bundle that generates heat to a certain temperature must be manufactured according to a design that sets the bundle's (thermal wire) own resistance value (total composite resistance value of multiple microfine wire strands that compose the bundle) and a specific heating temperature. Thereby, such bundle's (thermal wire) composite resistance-value is pre-determined by the proposed design.

The following is an embodiment of manufacturing a bundle (thermal wire) that generates heat to a certain temperature.

To provide an embodiment of manufacturing a certain bundle (thermal wire) that generates heat up to 100° C. of heating temperature, assume a thermal wire is manufactured according to environmental conditions of a drying facility, where it is set for 100° C. among above temperature conditions, and is used inside the floor space of the drying facility, assume one circuit of the thermal wire used is 10 m long based on the size of the drying facility's floor space, and assume that the thermal wire uses 24V of DC low-voltage.

The following describes a method of manufacturing above bundle (thermal wire) to heat via far-infrared radiation in the heater of the drying facility.

First, design the optimum composite resistance-value of a bundle (thermal wire), the heating element.

Calculate how much the bundle's (thermal wire) resistance value must be if the entire thermal wire generates heat at 100° C. from a consumption of 24V and its length of 10 m.

As, according to above data from experiments, 15.5 W of electric power is consumed per 1 m of the bundle (thermal wire) to heat the heating temperature up to 100° C. and one circuit of the bundle (thermal wire) is 10 m long, the total amount of electric power consumption needed per 1 circuit is 15.5 W×10 m=155 W.

W÷V=I is derived from the formula W (power consumption)=V (voltage)×I (current). Thus, since 155 W 24V=6.458 A, one circuit of the bundle (thermal wire) that is desired in the environment generates desired heat of 100° C. when a current of 6.458 A is flowed into its entire 10 m at a voltage of 24V.

Further, since the formula states V (voltage)=I (current)×R (resistance-value), the total resistance-value of the entire 10 m of the thermal wire is 24 V÷6.458 A=3.7163Ω.

Dividing the total resistance value of the bundle (thermal wire) by 10 m, the resistance value per 1 m of the bundle (thermal wire) that generates heat up to the desired temperature of 100° C. is 0.3716Ω.

After setting the calculated resistance-value of 0.3716Ω per 1 m of the thermal wire as a standard resistance-value, manufacture such bundle (thermal wire) with a resistance-value of 0.3716 Ω according to a method of bundle's (thermal wire) composite resistance-value controlling technology, which is later described in Embodiment 3-2-2

To provide another example of an embodiment of manufacturing a certain bundle (thermal wire) that generates heat up to 600° C., Assume a thermal wire is manufactured according to environmental conditions of a drying facility, where it is set for 600° C. among above temperature conditions and is attached to the ceiling space of the drying facility, assume one circuit of the thermal wire used is 10 m long based on the size of the drying facility's ceiling space, and assume that the thermal wire uses 96V of DC voltage.

The following describes a method of manufacturing above bundle (thermal wire) to heat via far-infrared radiation in the heater of the drying facility.

First, design the optimum composite resistance-value of a bundle (thermal wire), the heating element.

Calculate how much the bundle's (thermal wire) resistance value must be if the entire thermal wire generates heat up to 600° C. from a consumption of 96V and its length of 10 m.

As, according to above data from experiments, 100 W of electric power is consumed per 1 m of the bundle (thermal wire) to heat the heating temperature up to 60° C. and one circuit of the bundle (thermal wire) is 10 m long, the total amount of electric power consumption needed per 1 circuit is 100 W×10 m=1,000 W.

W÷V=I is derived from the formula W (power consumption)=V (voltage)×I (current). Thus, since 1000 W 96V=10.4 A, one circuit of the bundle (thermal wire) that is desired in the environment generates desired heat of 600° C. when a current of 10.4 A is flowed into its entire 10 m at a voltage of 85V.

Further, since the formula states V (voltage)=I (current)×R (resistance-value), the total resistance-value of the entire 10 m of the thermal wire is 96 V÷10.4 A=9.2307Ω.

Dividing the total resistance value of the bundle (thermal wire) by 10 m, the resistance value per 1 m of the bundle (thermal wire) that generates heat up to the desired temperature of 600° C. is 0.923Ω.

After setting the calculated resistance-value of 0.923Ω per 1 m of the thermal wire as a standard resistance-value, manufacture such bundle (thermal wire) with a resistance-value of 0.923Ω according to a method of bundle's (thermal wire) composite resistance-value controlling technology, which is later described in Embodiment 3-2-2

As a result, in order to control the size of the energy that the far-infrared radiation emitted from above bundle (thermal wire) possesses, the bundle's self heating temperature must be controlled, and in order to control such temperature, the bundle (thermal wire) must be manufactured according to its pre-determined composite resistance-value.

Embodiment 3-2-2

The following explains bundle's (thermal wire) composite resistance-value controlling technology in more detail from above Embodiment 3-2-1: a method of manufacturing a bundle (thermal wire) according to its pre-determined composite resistance-value to control such bundle's (thermal wire) self-heating temperature.

As above bundle is a thermal wire, which is an heating element that generates heat, the thermal wire generates heat according to the amount of electricity flowed in and its resistance value. In order to manufacture a thermal wire that has a certain amount of electric power (heat generated), the amount of electricity needed in that thermal wire must be flowed in. Ultimately, a thermal wire can only be manufactured if its resistance-value suits the given conditions assuming that the electric power used and the length of the thermal wire are determined.

For example, when two kinds of thermal wire are needed and both have an identical amount of electric power (heat generated), assume that thermal wires must be manufactured according to each given environmental condition of various inner thermal wire (bundle) lengths, Assume that the first thermal wire generates 100 W of electric power (heat), consumes 10V of voltage, and requires a 2 m of length. Assume that the second thermal wire generates 100 W of electric power (heat), consumes 10V of voltage, and requires a 1 m of length, Then, the current that can totally flow into the 2 m length of the first thermal wire is 10 A, and the resistance-value per 1 m of the thermal wire is 0.50. The current that can totally flow into 1 m length of the second thermal wire is 10 A as well, but the resistance-value per 1 m of the thermal wire must be 1Ω.

In such two cases, the resistance-values of each thermal wire must be differently manufactured in order to manufacture thermal wires needed in the field.

In such two cases, although the resistance-values of each thermal wire must be differently manufactured in order to manufacture thermal wires needed in the field, it is difficult to manufacture differentiated resistance-values with conventional technologies.

That is because, while most of current technology controls the resistance by simply changing the cross-sectional areas of a thermal wire and manufacturing such thermal wire, such method requires numerous equipment and complex manufacturing process. Furthermore, manufacturing thousands of specific resistance values are realistically impossible due to limitations of current equipments.

However, according to Embodiments 3-2-2-1 to 3-2-2-8 shown below, tens of thousands of resistance values that cannot be achieved by the current technology can be easily manufactured differently by the present invention.

Thus, a customized thermal wire can be manufactured with a method that controls the composite resistance-value of multiple microfine wire strands within the bundle (thermal wire) according to above Embodiment 3-2-1 or later explained Embodiment 4.

A formula of calculating above composite resistance-value is Composite Resistance=1÷(1/R1+1/R2+1/R3 . . . ).

If two kinds of thermal wires that need 0.50 and 10 resistance values per 1 m are needed, the following explains a method of controlling composite resistance-value.

Embodiment 3-2-2-1

The first method of controlling the composite resistance value is changing the number of microfine wire strands while keeping the thickness and material of the microfine wire same (identical resistance-value per 1 microfine wire as well).

For example, if one microfine wire's resistance-value is 10Ω, use and synthesize 10 strands of microfine wire to create a composite resistance-value of 1Ω.

That is, since 1/R1=1/10Ω=0.1Ω, 0.1Ω×10 strand=1Ω. Thus, the final total composite resistance-value is 1 Ω as 1/1Ω=1Ω.

Further, use and synthesize 20 strands of microfine wire to create a composite resistance-value of 0.5Ω.

That is, since 1/R1=1/10Ω=0.1Ω, 0.1Ω×20 strand=2Ω. Thus, the final total composite resistance-value is 0.5 Ω as ½Ω=0.5Ω.

Embodiment 3-2-2-2

The second method of controlling the composite resistance value is changing the thickness of the mirofine wire while keeping the number of strands and material of the microfine wire same.

For example, if one strand of the first mirofine strand is 100 μm thick with a resistance-value of 10 Ω and one strand of the second microfine strand is 200 μm thick with a resistance-value of 5Ω, use and synthesize 10 strands of the first 100 μm thick microfine wire to create a composite resistance-value of 1Ω.

That is, since 1/R1=1/10Ω=0.1Ω, 0.1Ω×10 strand=1Ω. Thus, the final total composite resistance-value is 1 Ω as 1/1Ω=1Ω.

Further, use and synthesize 10 strands of the second 200 μm thick microfine wire to create a composite resistance-value of 0.5Ω.

That is, since 1/R1=⅕Ω=0.2Ω, 0.2Ω×10 strand=2Ω. Thus, the final total composite resistance-value is 0.5 Ω as ½Ω=0.5Ω.

Embodiment 3-2-2-3

The third method of controlling the composite resistance value is changing the material of the microfine wire by having 2 or more materials while keeping the number of strands and thickness of the microfine wire same.

For example, if 5 strands of microfine wire are made of material A and a single strand's resistance-value is 10Ω, and if other 5 strands of microfine wire are made of material B and a single strand's resistance-value is 5Ω, use and synthesize 10 strands of microfine wire only made of material A to create a composite resistance-value of 1Ω.

That is, since 1/R1=1/10Ω=0.1Ω, 0.1Ω×10 strand=1Ω. Thus, the final total composite resistance-value is 1 Ω as 1/1Ω=1Ω.

Further, use and synthesize 10 strands of microfine wire only made of material B to create a composite resistance-value of 0.5Ω.

That is, since 1/R1=⅕Ω=0.2Ω, 0.2Ω×10 strand=2Ω. Thus, the final total composite resistance-value is 0.5 Ω as ½Ω=0.5Ω.

Embodiment 3-2-2-4

The fourth method of controlling the composite resistance value is differentiating the material of each of formed two or more groups of identical material and changing the type of material per each group while keeping the thickness and number of strands of microfine wire the same.

For example, if 5 strands of microfine wire are made of material A and a single strand's resistance-value is 10Ω, if 5 strands of microfine wire are made of material B and a single strand's resistance-value is also 10Ω, if 5 strands of microfine wire are made of material C and a single strand's resistance-value is 5Ω, and if 5 strands of microfine wire are made of material D and a single strand's resistance-value is also 5Ω, comprise and synthesize the first group with 5 strands of material A and the second group with 5 strands of material B to create a composite resistance-value of 1Ω.

That is, since material A's 1/R1=1/10Ω=0.1Ω and material B's 1/R1=1/10Ω=0.1Ω, the first group 0.1Ω×5 strand=0.5Ω and the second group 0.1Ω×5 strand=0.5Ω. Thus, when first and second groups are combined, the resistance-value becomes 1Ω, and the final total composite resistance-value is 1Ω as 1/1Ω=1Ω.

Further, comprise and synthesize the first group with 5 strands of material C and the second group with 5 strands of material D to create a composite resistance-value of 0.5Ω.

That is, since material C's 1/R1=⅕Ω=0.2Ω and material D's 1/R1=⅕Ω=0.2Ω, the first group 0.2Ω×5 strand=1Ω and the second group 0.2Ω×5 strand=1Ω. Thus, when first and second groups are combined, the resistance-value becomes 2Ω, and the final total composite resistance-value is 0.5Ω as ½Ω=0.5Ω.

Embodiment 3-2-2-5

The fifth method of controlling the composite resistance value is differentiating the material of each of formed two or more groups of identical material and changing the number of strands per each group while keeping the thickness of microfine wire the same.

For example, if 5 strands of microfine wire are made of material A and a single strand's resistance-value is 10Ω, and if 10 strands of microfine wire are made of material E and a single strand's resistance-value is 20Ω, comprise and synthesize the first group with 5 strands of material A and the second group with 10 strands of material E to create a composite resistance-value of 1Ω.

That is, since material A's 1/R1=1/10Ω=0.1Ω and material E's 1/R1=1/20Ω=0.05Ω, the first group 0.1Ω×5 strand=0.5Ω and the second group 0.05Ω×10 strand=0.5Ω. Thus, when first and second groups are combined, the resistance-value becomes 1Ω, and the final total composite resistance-value is 1Ω as 1/1Ω=1Ω.

Further, comprise and synthesize the first group with 10 strands of material A and the second group with 20 strands of material E to create a composite resistance-value of 0.5Ω.

That is, since material A's 1/R1=1/10Ω=0.1Ω and material e's 1/R1=1/20Ω=0.05Ω, the first group 0.1Ω×10 strand=1Ω and the second group 0.05Ω×20 strand=1Ω. Thus, when first and second groups are combined, the resistance-value becomes 2Ω, and the final total composite resistance-value is 0.5Ω as ½Ω=0.5Ω.

Embodiment 3-2-2-6

The sixth method of controlling the composite resistance value is differentiating the material of each of formed two or more groups of identical material and changing the thickness per each group (material) while keeping the number of strands of microfine wire per each group (material) or the entire bundle the same.

For example, if one strand in group material A has a thickness of 100 μm and a resistance-value of 10Ω, if one strand in group material B has a thickness of 200 μm and a resistance-value of 10Ω, if one strand in group material C has a thickness of 100 μm and a resistance-value of 5Ω, and if one strand in group material D has a thickness of 200 μm and a resistance-value of 5Ω, comprise and synthesize the first group with 5 strands of material A and the second group with 5 strands of material B to create a composite resistance-value of 1Ω.

That is, since material A's 1/R1=1/10Ω=0.1Ω and material B's 1/R1=1/10Ω=0.1Ω, the first group 0.1Ω×5 strand=0.5Ω and the second group 0.1Ω×5 strand=0.5Ω. Thus, when first and second groups are combined, the resistance-value becomes 1Ω, and the final total composite resistance-value is 1Ω as 1/1Ω=1Ω.

Further, comprise and synthesize the first group with 5 strands of material C and the second group with 5 strands of material D to create a composite resistance-value of 0.5Ω.

That is, since material C's 1/R1=⅕Ω=0.2Ω and material D's 1/R1=⅕Ω=0.2Ω, the first group 0.2Ω×5 strand=1Ω and the second group 0.2Ω×5 strand=1Ω. Thus, when first and second groups are combined, the resistance-value becomes 2Ω, and the final total composite resistance-value is 0.5Ω as ½Ω=0.5Ω.

Embodiment 3-2-2-7

The seventh method of controlling the composite resistance value is differentiating the material of each of formed two or more groups of identical material and changing the thickness and number of strands of microfine wire per each group (material).

Three most effective methods among above-described Embodiment 3-2-2-7 are,

② A method of having the first group's material identical but changing microfine wire's thickness and number of strands within the group and having the second group's material (different from first group's), the thickness, and the number of strands of microfine wire identical within the group, ② A method of having the first group's material identical but changing microfine wire's thickness and number of strands within the group and having the second group's material (different from first group's) and the thickness of microfine wire identical within the group but changing the number of microfine wire strands, ③ A method of having the first group's material identical but changing microfine wire's thickness and number of strands within the group and having the second group's material (different from first group's) and the number of microfine wire strands identical within the group but changing thickness of microfine wire.

As an example to explain above method ①, in group material A, if one strand has a thickness of 100 μm and a resistance-value of 10Ω and another strand has a thickness of 50 μm and a resistance-value of 20Ω, and, in group material B, if one strand has a thickness of 50 μm and a resistance-value of 20Ω, The first method of creating a composite resistance-value of 1 Ω is changing the thickness and number of strands of the first group while keeping the second group identical and comprising and synthesizing 5 strands of 100 μm thickness from the first group (material A) and 10 strands of 50 μm thickness from the second group (material B).

That is, since 100 μm thickness of material A's 1/R1=1/10Ω=0.1Ω and 50 μm thickness of material B's 1/R1=1/20Ω=0.05Ω, the first group 0.1Ω×5 strand=0.5Ω and the second group 0.05Ω×10 strand=0.5Ω. Thus, when first and second groups are combined, the resistance-value becomes 1Ω, and the final total composite resistance-value is 1Ω as 1/1Ω=1Ω.

The second method of creating a composite resistance-value of 1 Ω is changing the thickness and number of strands of the first group while keeping the second group identical and comprising and synthesizing 10 strands of 50 μm thickness from the first group (material A) and 10 strands of 50 μm thickness from the second group (material B).

That is, since 50 μm thickness of material A's 1/R1=1/20Ω=0.05Ω and 50 μm thickness of material B's 1/R1=1/20Ω=0.05Ω, the first group 0.05Ω×10 strand=0.5Ω and the second group 0.05Ω×10 strand=0.5Ω. Thus, when first and second groups are combined, the resistance-value becomes 1Ω, and the final total composite resistance-value is 1Ω as 1/1Ω=1Ω.

Further, the first method of creating a composite resistance-value of 0.5 Ω is changing the thickness and number of strands of the first group while keeping the second group identical and comprising and synthesizing 10 strands of 100 μm thickness from the first group (material A) and 20 strands of 50 μm thickness from the second group (material B).

That is, since 100 μm thickness of material A's 1/R1=1/10Ω=0.1Ω and 50 μm thickness of material B's 1/R1=1/20Ω=0.05Ω, the first group 0.1Ω×10 strand=1Ω and the second group 0.05Ω×20 strand=1Ω. Thus, when first and second groups are combined, the resistance-value becomes 2Ω, and the final total composite resistance-value is 0.5Ω as ½Ω=0.5Ω.

The second method of creating a composite resistance-value of 0.05 Ω is changing the thickness and number of strands of the first group while keeping the second group identical and comprising and synthesizing 20 strands of 50 μm thickness from the first group (material A) and 20 strands of 50 μm thickness from the second group (material B).

That is, since 50 μm thickness of material A's 1/R1=1/20Ω=0.05Ω and 50 μm thickness of material B's 1/R1=1/20Ω=0.05Ω, the first group 0.05Ω×20 strand=1Ω and the second group 0.05Ω×20 strand=1Ω. Thus, when first and second groups are combined, the resistance-value becomes 2Ω, and the final total composite resistance-value is 0.5Ω as ½Ω=0.5Ω.

As an example to explain above method ②, in group material A, if one strand has a thickness of 100 μm and a resistance-value of 10Ω and another strand has a thickness of 50 μm and a resistance-value of 20Ω, and, in group material B, if one strand has a thickness of 50 μm and a resistance-value of 20Ω and another strand has a thickness of 25 μm and a resistance-value of 40Ω, In this case, the first and second method of creating a composite resistance-value of 1 Ω are identical to above method ①.

Further, the first method of creating a composite resistance-value of 0.5 Ω is keeping the first group's number of strands and thickness identical, similar to above method of creating a composite resistance-value of 1 Ω (keeping the first group's material same but changing the number of strands and thickness), and changing the number of strands of the second group while keeping the thickness identical to above method of creating a composite resistance-value of 1Ω.

In other words, comprise and synthesize the first group (material A) with 5 strands of 100 μm thickness, identical to above first method of creating 1 Ω composite resistance value, and the second group (material B) with 30 strands of 50 μm thickness, similar, but with difference in number of strands, to above first method of creating 1 Ω composite resistance value.

That is, since 100 μm thickness of material A's 1/R1=1/10Ω=0.1Ω and 50 μm thickness of material B's 1/R1=1/20Ω=0.05Ω, the first group's 100 μm thickness 0.1Ω×5 strand=0.5Ω and the second group's 50 μm thickness 0.05Ω×30 strand=1.5Ω. Thus, when first and second groups are combined, the resistance-value becomes 2Ω, and the final total composite resistance-value is 0.5Ω as ½Ω=0.5Ω.

The second method of creating a composite resistance-value of 0.5 Ω is keeping the first group's number of strands and thickness identical, similar to above method of creating a composite resistance-value of 1Ω, and changing the number of strands of the second group while keeping the thickness identical to above method of creating a composite resistance-value of 1Ω.

In other words, comprise and synthesize the first group (material A) with 10 strands of 50 μm thickness, identical to above second method of creating 1 Ω composite resistance value, and the second group (material B) with 30 strands of 50 μm thickness, similar, but with difference in number of strands, to above second method of creating 1 Ω composite resistance value.

That is, since 50 μm thickness of material A's 1/R1=1/20Ω=0.05Ω and 50 μm thickness of material B's 1/R1=1/20Ω=0.05Ω, the first group's 50 μm thickness 0.05Ω×10 strand=0.5Ω and the second group's 50 μm thickness 0.05Ω×30 strand=1.5Ω. Thus, when first and second groups are combined, the resistance-value becomes 2Ω, and the final total composite resistance-value is 0.5Ω as ½Ω=0.5Ω.

Further, the first method of creating a composite resistance-value of 0.25 Ω is keeping the first group's number of strands and thickness identical, similar to above method of creating a composite resistance-value of 1Ω, and changing the number of strands of the second group while keeping the thickness identical to above method of creating a composite resistance-value of 1Ω.

In other words, comprise and synthesize the first group (material A) with 5 strands of 100 μm thickness, identical to above first method of creating 1 Ω composite resistance value, and the second group (material B) with 70 strands of 50 μm thickness, similar, but with difference in number of strands, to above first method of creating 1 Ω composite resistance value.

That is, since 100 μm thickness of material A's 1/R1=1/10Ω=0.1Ω and 50 μm thickness of material B's 1/R1=1/20Ω=0.05Ω, the first group's 100 μm thickness 0.1Ω×5 strand=0.5Ω and the second group's 50 μm thickness 0.05Ω×70 strand=3.5Ω. Thus, when first and second groups are combined, the resistance-value becomes 4Ω, and the final total composite resistance-value is 0.25Ω as ¼Ω=0.25Ω.

The second method of creating a composite resistance-value of 0.25 Ω is keeping the first group's number of strands and thickness identical, similar to above method of creating a composite resistance-value of 1Ω, and changing the number of strands of the second group while keeping the thickness identical to above method of creating a composite resistance-value of 1Ω.

In other words, comprise and synthesize the first group (material A) with 10 strands of 50 μm thickness, identical to above second method of creating 1 Ω composite resistance value, and the second group (material B) with 70 strands of 50 μm thickness, similar, but with difference in number of strands, to above second method of creating 1 Ω composite resistance value.

That is, since 50 μm thickness of material A's 1/R1=1/20Ω=0.05Ω and 50 μm thickness of material B's 1/R1=1/20Ω=0.05Ω, the first group's 50 μm thickness 0.05Ω×10 strand=0.5Ω and the second group's 50 μm thickness 0.05Ω×70 strand=3.5Ω. Thus, when first and second groups are combined, the resistance-value becomes 4Ω, and the final total composite resistance-value is 0.25Ω as ¼Ω=0.25Ω.

As an example to explain above method ③, in group material A, if one strand has a thickness of 100 μm and a resistance-value of 10Ω, one strand has a thickness of 69 μm and a resistance-value of 26.666Ω, one strand has a thickness of 65 μm and a resistance-value of 15.384Ω, and one strand has a thickness of 25 μm and a resistance-value of 40Ω, and, in group material B, if one strand has a thickness of 100 μm and a resistance-value of 10Ω, one strand has a thickness of 70 μm and a resistance-value of 14.2857Ω, one strand has a thickness of 50 μm and a resistance-value of 20Ω, and one strand has a thickness of 25 μm and a resistance-value of 40Ω, In this case, while a method of creating 1Ω composite resistance-value is identical to the first method of above method ①, assume that the first method is identical to first method of above method ① as a standard to compare the difference in materialization of below method ③.

That is, since 100 μm thickness of material A's 1/R1=1/10Ω=0.1Ω and 50 μm thickness of material B's 1/R1=1/20Ω=0.05Ω, the first group 0.1Ω×5 strand=0.5Ω and the second group 0.05Ω×10 strand=0.5Ω. Thus, when first and second groups are combined, the resistance-value becomes 1Ω, and the final total composite resistance-value is 1Ω as 1/1Ω=1Ω.

The second method of creating a composite resistance-value of 1 Ω is changing the first group's thickness and number of strands and the second group's thickness while keeping the same number of strands. Comprise and synthesize the first group (material A) with 20 strands of 69 μm thick wire and the second group (material B) with 10 strands of 25 μm thick wire.

That is, since 69 μm thickness of material A's 1/R1=1/26.666Ω=0.0375Ω and 25 μm thickness of material B's 1/R1=1/40Ω=0.025Ω, the first group 0.0375Ω×20 strand=0.75Ω and the second group 0.025Ω×10 strand=0.25Ω. Thus, when first and second groups are combined, the resistance-value becomes 1Ω, and the final total composite resistance-value is 1Ω as 1/1Ω=1Ω.

The first method of creating a composite resistance-value of 0.5 Ω is changing the first group's thickness and number of strands and the second group's thickness while keeping the same number of strands. Comprise and synthesize the first group (material A) with 40 strands of 25 μm thick wire and the second group (material B) with 10 strands of 100 μm thick wire.

That is, since 25 μm thickness of material A's 1/R1=1/40Ω=0.025Ω and 100 μm thickness of material B's 1/R1=1/10Ω=0.1Ω, the first group 0.025Ω×40 strand=1Ω and the second group 0.1Ω×10 strand=1Ω. Thus, when first and second groups are combined, the resistance-value becomes 2Ω, and the final total composite resistance-value is 0.5Ω as ½Ω=0.5Ω.

The second method of creating a composite resistance-value of 0.5 Ω is changing the first group's thickness and number of strands and the second group's thickness while keeping the same number of strands. Comprise and synthesize the first group (material A) with 20 strands of 65 μm thick wire and the second group (material B) with 10 strands of 70 μm thick wire.

That is, since 65 μm thickness of material A's 1/R1=1/15.384Ω=0.065Ω and 70 μm thickness of material B's 1/R1=1/14.2857Ω=0.07Ω, the first group 0.065Ω×20 strand=1.3Ω and the second group 0.07Ω×10 strand=0.7Ω. Thus, when first and second groups are combined, the resistance-value becomes 2Ω, and the final total composite resistance-value is 0.5Ω as ½Ω=0.5Ω.

Embodiment 3-2-2-8

As a method that synthesizes all or selectively synthesizes variety of embodiments 3-2-2-1 through 3-2-2-7, Embodiment 3-2-2-8 is a method of specifically customizing the resistance-value by adjusting total composite resistance-value.

Among above diverse embodiments, the most practical and effective two methods are first and second methods of Embodiment 3-2-2-7, and, between the two, the most appropriate method to manufacture is the second method.

And, later described Embodiments 5-1 through 5-8 actually materialize such functions and are selected to be implemented among one or more of above methods or selectively synthesized methods.

Embodiment 3-3

As a method of combining above methods of first and second clauses of ③ of Embodiment 3, the following further explains a method of controlling the heating temperature of one bundle (thermal wire) while changing the number of microfine wire strands.

As described in above Embodiment 3-1, the amount of far-infrared radiation emitted from the thermal wire can be controlled by changing (controlling) the bundle's number of microfine wire strands. And, as described in above Embodiment 3-1, the size of energy that the far-infrared radiation emitted from a bundle (thermal wire) possesses can be controlled by controlling the heating temperature of a bundle (thermal wire).

Ultimately, a method (technology) of increasing the amount of far-infrared radiation radiated from a bundle (thermal wire) while simultaneously increasing the size of energy possessed involves increasing the heating temperature of the bundle (thermal wire) while increasing the number of multiple microfine wire strands in the bundle (thermal wire) at the same time.

Embodiment 4

Synthesizing above stated results, a method of manufacturing a more effective thermal wire (120*a*) that emits far-infrared radiation from Embodiment 1 is making a microfine wire with a small resistance-value that emits far-infrared radiation when electricity is flowed in and making one strand of thermal wire by bundling multiple strands of above microfine wire that come into contact of each other.

Further, the thermal wire, bundled into one, is in a parallel composite structure, where multiple strands of microfine wire with a small resistance-value that emits far-infrared radiation when electricity is flowed in come into contact of each other.

Embodiment 4-1

As the material of the microfine wire in above Embodiment 4, a single metal or an alloy metal is a material that emits large amounts of far-infrared radiation (especially, a material where dipole moment occurs when electricity is flowed in) more effectively.

Of these single metal or alloy metals, materials that are particularly effective are as follows as a result of experimenting bought or manufactured samples.

First, stainless steel type alloys may be used. Especially, SUS 316 is most effective and more effective when manufactured more finely.

Second, the ready-made steel fiber (metal fiber) (NASLON), which performs the same function as the first SUS 316, may be used.

Third, there is a method of manufacturing special alloy metal to perform such functions. An alloy of nickel and copper, wherein the mixing ratio is 20-25% by weight of nickel and 75 to 80% by weight of copper, may be used.

Further, an alloy of iron, chromium, alumina, and molybdenum, where in the mixing ratio is 68 to 73% by weight of iron, 18 to 22% by weight of chromium, 5 to 6% by weight of alumina, and remaining percent by weight of molybdenum, with small addition of silicon, manganese, and carbon may be used.

Fourth, a single metal such as copper may be used.

Fifth, materials manufactured through a method of mixing above four materials may be used.

For example, while making two groups of types of microfine wire used in above manufactured bundle (thermal wire, heating element), the first group must use the first material of stainless steel type alloys or the second material, and the second group may use third material of nickel and copper alloy or an iron, chromium, alumina, and molybdenum mixed alloy.

Among methods of manufacturing a thermal wire using above materials, a thermal wire manufactured using a mixture of any one or more of a single metal copper or above alloy metals is explained later in Embodiments 5-5 through 5-6.

Further, a thermal wire manufactured using a mixture of any above alloy metals is explained later in Embodiments 5-1 through 5-4, 5-7, and 5-8.

Embodiment 4-2

The following explains a method of maintaining an uniform resistance-value throughout a microfine wire with a small amount of resistance-value that emits far-infrared radiation when electricity is flowed in.

It is very important for the bundle (thermal wire) to have an uniform resistance-value longitudinally throughout its longitudinal direction.

If, the microfine wires do not have an uniform resistance-value throughout its longitudinal direction, the electricity may be concentrated in parts, where the resistance-value is uneven, and cause a fire, an electric shock, or a short circuit.

To solve such problem, one strand of each microfine wire must be manufactured to have an uniform and even resistance-value throughout its longitudinal direction. Further, a bundle that contains multiple microfine wire strands that each have an uniform resistance-value must be used in the first place.

Therefore, a method of manufacturing a microfine wire that each has an uniform and even resistance-value throughout its longitudinal direction includes, first, a method of using a microfine metal filament wire drawn from a wire-drawing machine with a single or an alloy metal as the microfine wire, second, a method of using a metal microfine wire spun from a spinning machine with a single or an alloy metal as the microfine wire, and, third, a method of using a steel fiber (metal fiber) (NASLON) as the microfine wire.

Using the wire-drawing machine of the first method to manufacture microfine filament wire, the Drawing method can be used.

After making every microfine wire to each have an uniform resistance-value throughout its longitudinal direction using above 3 methods, the bundle (thermal wire) has an internal, uniform resistance-value throughout its longitudinal direction when those microfine wire strands are bundled, and, ultimately, the entire bundle (thermal wire) has an uniform resistance-value and is electrically safe.

However, due to the limitations of the precision of the machine (equipment, apparatus) or of the uniformity in the actual manufacturing process, the degree of uniformity may not be complete 100% and may vary.

Embodiment 4-3

The following describes a method of manufacturing one strand of thermal wire by bundling multiple microfine wire strands that come into contact of each other from above Embodiment 4.

If multiple strands of microfine wire that comprise the above bundle are not closely adhered to each other as one body, the bundle may overheat, be damaged, or cause a fire as the widening of the gaps in between microfine wire strands creates a potential different and causes current reversal or uneven concentration of electricity.

Therefore, through a method of tightly adhering multiple strands of microfine wire (a method of bundling), the thermal wire must be manufactured, wherein the multiple microfine wire strands have one yarn-like structure and uniform length.

The bundling method is as follows. First, synthesize multiple strands of microfine wire together. Wrapping the synthesized bundle's outer layer, the high-temperature yarn (fiber) forms as a sheath of multiple microfine wire strands inside so that the bundle seems like one single strand of a yarn when viewed from the outside.

The high-temperature fiber used may be a yarn made of aramid, polyarylate, or zyron (PBO fiber).

As FIG. 1 exhibits a thermal wire (120*a*) manufactured according to the first bundling method, it can be inferred that the high-temperature fiber (120*c*) may form as a sheath of the synthesized multiple strands of microfine wire (120*b*) by repeatedly wrapping the bundle along the longitudinal direction.

Second, bundle the multiple strands of microfine wire as one body by twisting themselves together using a double twister.

Third, bundle the multiple strands of microfine wire by coating and drawing the bundle using a coating-machine.

The coating material used at this time may be Teflon, PVC, or silicone.

Fourth, bundle the multiple strands of microfine wire by placing them in between the upper and lower plates of plated material and melting the adhesive in between the plates.

The plate material used at this time may be a pet plate, a general fabric plate, or a clay plate.

Further, the above adhesive used may be a TPU liquid, a TPU plate, a silicon liquid or a silicon plate, or a hot melt liquid or plate.

Further, the above method of melting the adhesive used may be heat press and heat compression, which will melt the adhesive and fix the inner microfine wire by sinking and impregnating it, or high-frequency emitter and compressor, which will melt and compress the adhesive with its high frequency and fix the inner microfine wire by sinking and impregnating it.

Fifth, bundle the multiple strands of microfine wire by synthesizing any of above four methods or selectively synthesizing them in various ways.

For example, bundling by coating the bundle manufactured by the first or second method two or more times (coating above the coated layer) by the third method or by drawing and coating the coated strand with identical or different material per every coat applied.

That is, the microfine wires may be bundled by coating the product of first or second method once or more through a coating-machine and using identical, partially different, or entirely different material for every coat applied.

Embodiment 5

The following depicts actual materialization of the most effective thermal wire (bundle), wherein multiple microfine wire strands with small resistance-value that emit far-infrared radiation when electricity is flowed in are bundled in a parallel composite structure, that can be used as a heating element by above embodiments 1 through 4 or more than one method or mixed methods.

Embodiment 5-1

A far-infrared radiation thermal wire made to have a bundle composite resistance value of 1.37Ω per 1 m of the thermal wire is, A single bundled thermal wire in a geometric composite structure that is composed of multiple strands of microfine wire with a small resistance-value that emit far-infrared radiation when electricity is flowed in, Manufactured in two kinds of microfine wire material, identical thickness of each material's microfine wire, and different thickness and number of strands per each material, Composed of 550 strands of 12 μm thick microfine wire with Material 1, being SUS 316 or steel fiber NASLON and 24 strands of 100 μm thick (resistance-value of 36Ω per one strand) microfine wire with Material 2, being a single metal of nickel and copper with a mixing ratio of 20-25% nickel by weight and 75-80% copper by weight, And manufactured by bundling these two kinds of material into one.

Embodiment 5-2

A far-infrared radiation thermal wire made to have a bundle composite resistance value of 2.150 per 1 m of the thermal wire is, A single bundled thermal wire in a geometric composite structure that is composed of multiple strands of microfine wire with a small resistance-value that emit far-infrared radiation when electricity is flowed in, Manufactured in two kinds of microfine wire material, identical thickness of microfine wire within each group, and different thickness and number of strands per each material, Composed of 550 strands of 12 μm thick microfine wire with Material 1, being SUS 316 or steel fiber NASLON and 14 strands of 100 μm thick (resistance-value of 360 per one strand) microfine wire with Material 2, being a single metal of nickel and copper with a mixing ratio of 20-25% nickel by weight and 75-80% copper by weight, And manufactured by bundling these two kinds of material into one.

Embodiment 5-3

A far-infrared radiation thermal wire made to have a bundle composite resistance value of 3.120 per 1 m of the thermal wire is, A single bundled thermal wire in a geometric composite structure that is composed of multiple strands of microfine wire with a small resistance-value that emit far-infrared radiation when electricity is flowed in, Manufactured in two kinds of microfine wire material, identical thickness of microfine wire within each group, and different thickness and number of strands per each material, Composed of 550 strands of 12 μm thick microfine wire with Material 1, being SUS 316 or steel fiber NASLON and 9 strands of 100 μm thick (resistance-value of 36Ω per one strand) microfine wire with Material 2, being a single metal of nickel and copper with a mixing ratio of 20-25% nickel by weight and 75-80% copper by weight, And manufactured by bundling these two kinds of material into one.

Embodiment 5-4

A far-infrared radiation thermal wire made to have a bundle composite resistance value of 0.4950 per 1 m of the thermal wire is, A single bundled thermal wire in a geometric composite structure that is composed of multiple strands of microfine wire with a small resistance-value that emit far-infrared radiation when electricity is flowed in, Manufactured in two kinds of microfine wire material, identical material of microfine wire within each group, and different material and number of strands per each material, Composed of 1,100 strands of 12 μm thick microfine wire with Material 1, being SUS 316 or steel fiber NASLON and 45 strands of 180 μm thick microfine wire with Material 2, being a single metal of nickel and copper with a mixing ratio of 20-25% nickel by weight and 75-80% copper by weight, And manufactured by bundling these two kinds of material into one.

Embodiment 5-5

A far-infrared radiation thermal wire made to have a bundle composite resistance value of 0.314Ω per 1 m of the thermal wire is, A single bundled thermal wire in a geometric composite structure that is composed of multiple strands of microfine wire with a small resistance-value that emit far-infrared radiation when electricity is flowed in, Manufactured in three kinds of microfine wire material, identical material of microfine wire within each group, and different material and number of strands per each group Composed of 1,100 strands of 12 μm thick microfine wire with Material 1, being SUS 316 or steel fiber NASLON, 9 strands of 180 μm thick microfine wire with Material 2, being a single metal of nickel and copper with a mixing ratio of 20-25% nickel by weight and 75-80% copper by weight, and 2 strands of 140 μm thick microfine wire with Material 3, being a single metal of copper, And manufactured by bundling these three kinds of material into one.

Embodiment 5-6

A far-infrared radiation thermal wire made to have a bundle composite resistance value of 0.202Ω per 1 m of the thermal wire is, A single bundled thermal wire in a geometric composite structure that is composed of multiple strands of microfine wire with a small resistance-value that emit far-infrared radiation when electricity is flowed in, Manufactured in three groups with three kinds of microfine wire material, identical material of microfine wire within each group, and different material and number of strands per each group, Composed of 1,100 strands of 12 μm thick microfine wire with Material 1, being SUS 316 or steel fiber NASLON, 9 strands of 180 μm thick microfine wire with Material 2, being a single metal of nickel and copper with a mixing ratio of 20-25% nickel by weight and 75-80% copper by weight, and 3 strands of 140 μm thick microfine wire with Material 3, being a single metal of copper, And manufactured by bundling these three kinds of material into one.

Embodiment 5-7

A far-infrared radiation thermal wire made to have a bundle composite resistance value of 140 per 1 m of the thermal wire is, A single bundled thermal wire in a geometric composite structure that is composed of multiple strands of microfine wire with a small resistance-value that emit far-infrared radiation when electricity is flowed in, Manufactured in one kind of microfine wire material and in identical thickness but different number of strands, Composed of 550 strands of 12 μm thick microfine wire with Material 1, being SUS 316 or steel fiber NASLON, And manufactured by bundling these 550 strands into one.

Embodiment 5-8

A far-infrared radiation thermal wire made to have a bundle composite resistance value of 7Ω per 1 m of the thermal wire is, A single bundled thermal wire in a geometric composite structure that is composed of multiple strands of microfine wire with a small resistance-value that emit far-infrared radiation when electricity is flowed in, Manufactured in one kind of microfine wire material and in identical thickness but different number of strands, Composed of 1,100 strands of 12 μm thick microfine wire with Material 1, being SUS 316 or steel fiber NASLON, And manufactured by bundling these 1,100 strands into one.

As above radiant heating through a far-infrared radiation thermal wire does not transmit heat through convection or conduction but directly transmits heat, similar to the principal of the sun heating the earth, it may conserve 30 to 50% of energy and has an advantage of not generating noise, smell, or dust (Refereed *Daily Economy Vocabulary Dictionary*).

The invention claimed is:

1. A method of manufacturing far-infrared radiation thermal wire comprising steps of:

making microfine wire that emits far-infrared radiation as it generates heat according to the resistance value when electricity is flowed in;

making one strand of thermal wire by bundling strands of the microfine wire that are in contact with each other;

making two or more groups, each of the groups having different resistance values and comprising one or more strands of the microfine wire that have an identical resistance value, in order to make the bundle into an effective geometric structure that radiates electric dipole radiation while emitting far-infrared radiation; and changing (adjusting) the number of strands of the bundle's microfine wire, or changing (adjusting) the self-heating temperature of the bundle, to effectively control the far-infrared radiation emission, or both.

2. The method of manufacturing far-infrared radiation thermal wire of claim 1:

wherein the microfine wire is made of material that emit a large amount of far-infrared radiation by the dipole moment occurred when electricity flows in.

3. The method of manufacturing far-infrared radiation thermal wire of claim 1:

wherein two or more groups have different heat generating functions, are made of different materials, or have different thicknesses while each group comprises one or more strands of the microfine wire with an identical resistance value in order to differentiate resistance values of each group.

4. The method of manufacturing far-infrared radiation thermal wire of claim 1:

wherein the step of changing (adjusting) the number of strands of the bundle is accomplished by changing (adjusting) the number of strands of the bundle while having one or more identical conditions of the resistance value, material, or thickness of the microfine wire to control the amount of far-infrared radiation.

5. The method of manufacturing far-infrared radiation thermal wire of claim 4:

wherein the step of changing (adjusting) the number of strands of the bundle's bundle while having one or more identical conditions of the resistance value, material, or thickness of the microfine wire is controlling the number of microfine wire strands while keeping the combined resistance value per unit length of one bundle (thermal wire) the same.

6. The method of manufacturing far-infrared radiation thermal wire of claim 1:

wherein the step of changing (adjusting) the number of strands of the bundle's microfine wire is controlling the number of microfine wire strands within each group while the combined resistance value per unit length of one bundle (thermal wire) is identical in a state of multiple groups each comprising of multiple strands of microfine wire having the identical resistance value or the material.

7. The method of manufacturing far-infrared radiation thermal wire of claim 1: wherein the step of changing (adjusting) the self-heating temperature of the bundle is changing the self-heating temperature within a range of 80° C. to 600° C.

8. The method of manufacturing far-infrared radiation thermal wire of claim 1 or claim 7:

wherein the step of changing (adjusting) the self-heating temperature of the bundle is changing the total composite resistance value of the bundle's multiple microfine wire strands to adjust to the bundle's specific resistance value per unit length.

9. The method of manufacturing far-infrared radiation thermal wire of claim 8:

wherein the step of changing the total composite resistance value of multiple microfine wire strands includes one or more methods selected from;

the first method, changing the microfine wire's total number of strands while keeping the material and the thickness of microfine wire's multiple strands identical;

the second method, changing the microfine wire's thickness while keeping the material and the number of microfine wire's multiple strands identical;

the third method, changing the microfine wire's material while keeping the thickness and the number of microfine wire's multiple strands identical;

the fourth method, changing the material of the microfine wire within each group uniformly after forming two or more groups of different materials while keeping the thickness and number of microfine wire's multiple strands identical;

the fifth method, changing the number of microfine wire strands within each group after forming two or more groups of different materials while keeping the thickness of microfine wire's multiple strands identical;

the sixth method, changing the thickness of microfine wires within each group after forming two or more groups of different materials while keeping each group's or bundle's total number of multiple microfine wire strands identical; and the seventh method, changing the thickness and number of multiple microfine wire strands within each group after forming two or more groups of different materials.

10. The method of manufacturing far-infrared radiation thermal wire of claim 9:

wherein the seventh method is characterized by any one method of;

changing microfine wire's thickness and number of strands in Group 1 while the Group 1's material is identical, and making the Group 2's material and microfine wire's thickness and number of strands identical while the Group 2's material is different from the Group 1's material;

changing microfine wire's thickness and number of strands in Group 1 while the Group 1's material is identical, and changing the number of strands in Group 2 while the Group 2's material and microfine wire's thickness are identical and the Group 2's material is different from the Group 1's material; or changing microfine wire's thickness and number of strands in Group 1 while the Group 1's material is identical, and changing the thickness in Group 2 while the Group 2's material and microfine wire's number of strands are identical and the Group 2's material is different from the Group 1's material.

11. The method of manufacturing far-infrared radiation thermal wire of claim 1 or claim 2:

wherein the material of the microfine wire is a single metal or an alloy.

12. The method of manufacturing far-infrared radiation thermal wire of claim 11:

wherein the material of the single metal is copper.

13. The method of manufacturing far-infrared radiation thermal wire of claim 11:

wherein the alloy metal is made of any one or more of;

SUS 316 as an alloy metal of stainless steel series, steel fiber (metal fiber) (NASLON);

an alloy of nickel and copper made from a mixing ratio of nickel 20-25% by weight, copper 75-80% by weight; or an alloy made of iron 68-73% by weight, chromium 18-22% by weight, alumina 5-6% by weight, molybdenum 3-4% by weight.

14. The method of manufacturing far-infrared radiation thermal wire of claim 13:

wherein silicon, manganese, and carbon are added into the alloy made of iron 68-73% by weight, chromium 18-22% by weight, alumina 5-6% by weight, molybdenum 3-4% by weight.

15. The method of manufacturing far-infrared radiation thermal wire of claim 1:

the microfine wire is made by any one or more of;

making a single metal or an alloy metal as a fine metal filament through a drawing machine and using it as the microfine wire;

making the single metal or the alloy metal as a metal spun yarn through a spinning machine and using it as the microfine wire; or using a steel fiber (metal fiber) (NASLON) as the microfine wire in order for the microfine wires to have a uniform resistance value as a whole.

16. The method of manufacturing far-infrared radiation thermal wire of claim 1:

the bundle is made by any one or more of;

the first method, wrapping and coating microfine wires with high-temperature fibers along the longitudinal direction, the second method, twisting itself to become a single body through a double twister, the third method, coating and pulling out through a coating machine, the fourth method, repeating the third method two or more times, the fifth method, using a different material of coating per each coating from the fourth method, the sixth method, coating and pulling out the product of the first or the second method once or more through the coating machine, the seventh method, coating the product of the first or the second method once or more with identical coating material per coating, identical coating material per a part of coating and different coating material per a part of coating, and different coating material per coating through a coating machine, and the eight method, placing an adhesive between upper and lower plates of plated material and melting the adhesive.

17. The method of manufacturing far-infrared radiation thermal wire of claim 16:

wherein the high-temperature fiber used in the first method is aramid, polyarylate, or zyron.

18. The method of manufacturing far-infrared radiation thermal wire of claim 16:

wherein the coating material used in the third and the seventh methods is teflon, PVC, or silicon.

19. A far-infrared radiation thermal wire comprising:

a bundle of strands of microfine wire, the bundle having a parallel composite structure, where proximate multiple strands of the microfine wire compile together as they emit far-infrared radiation while generating heat according to their resistance value when electricity is flowed in;

wherein the bundle is in a geometric structure, which emits electric dipole radiation of far-infrared ray while having different numbers of microfine wire strands when the multiple strands have one or more of the identical resistance value, material, or thickness, wherein the bundle generates heat only when the bundle is within a temperature range of 80° C. to 600° C.

20. The far-infrared radiation thermal wire of claim 19:

wherein the microfine wire is made of a material that emits a large amount of far-infrared radiation with a dipole moment when electricity flows in.

21. The far-infrared radiation thermal wire of claim 19:

wherein the material of the microfine wire is a single metal or an alloy metal.

22. The far-infrared radiation thermal wire of claim 21:

wherein the material of the single metal is copper.

23. The far-infrared radiation thermal wire of claim 21:

wherein the alloy metal is made of any one or more of;

SUS 316 as an alloy metal of stainless steel series;

steel fiber (metal fiber) (NASLON);

an alloy of nickel and copper made from a mixing ratio of nickel 20-25% by weight, copper 75-80% by weight; or an alloy made of iron 68-73% by weight, chromium 18-22% by weight, alumina 5-6% by weight, molybdenum 3-4% of weight.

24. The far-infrared radiation thermal wire of claim 23:

wherein silicon, manganese, and carbon are added into the metal alloy made of iron 68-73% by weight, chromium 18-22% by weight, alumina 5-6% by weight, molybdenum 3-4% by weight.

25. A far-infrared radiation thermal wire comprising:

a bundle of the thermal wires which is in a parallel composite structure, where proximate multiple strands of microfine wire compile together as they emit far-infrared radiation while generating heat according to their resistance value when electricity is flowed in;

wherein the thermal wires are made of two kinds of material with identical thickness of microfine wires for each material but different thickness and number of strands between each material;

wherein one material comprise 550 strands of 12 μm thick microfine wire, being SUS 316 or steel fiber NASLON; and the other material comprise 24 strands of 100 μm thick (resistance-value of 36Ω per one strand) microfine wire, being a single metal of nickel and copper with a mixing ratio of 20-25% nickel by weight and 75-80% copper by weight;

wherein the strands of two materials are bundled into one and the bundle have the resistance value per 1 m length of the thermal wire as 1.37 Ω.

26. A far-infrared radiation thermal wire comprising:

a bundle of the thermal wires which is in a parallel composite structure, where proximate multiple strands of microfine wire compile together as they emit far-infrared radiation while generating heat according to their resistance value when electricity is flowed in;

wherein the thermal wires are made of two kinds of material with identical thickness of microfine wires for each material but different thickness and number of strands between each material;

wherein one material comprise 550 strands of 12 μm thick microfine wire with, being SUS 316 or steel fiber NASLON; and the other material comprise 14 strands of 100 μm thick (resistance-value of 36Ω per one strand) microfine, being a single metal of nickel and copper with a mixing ratio of 20-25% nickel by weight and 75-80% copper by weight;

wherein the strands of the two materials are bundled into one and the bundle have the resistance value per 1 m length of the thermal wire as 2.15 Ω.

27. A far-infrared radiation thermal wire comprising:

a bundle of the thermal wires which is in a parallel composite structure, where proximate multiple strands of microfine wire compile together as they emit far-infrared radiation while generating heat according to their resistance value when electricity is flowed in;

wherein the thermal wires are made of two kinds of material with identical thickness of microfine wires for each material but different thickness and number of strands between each material;

wherein one material comprise 550 strands of 12 μm thick microfine wire, being SUS 316 or steel fiber NASLON; and the other material comprise 9 strands of 100 μm thick (resistance-value of 36Ω per one strand) microfine wire, being a single metal of nickel and copper with a mixing ratio of 20-25% nickel by weight and 75-80% copper by weight;

wherein the strands of the two materials are bundled into one and the bundle have the resistance value per 1 m length of the thermal wire as 3.12 Ω.

28. A far-infrared radiation thermal wire comprising:

a bundle of the thermal wires which is in a parallel composite structure, where proximate multiple strands of microfine wire compile together as they emit far-infrared radiation while generating heat according to their resistance value when electricity is flowed in;

wherein the thermal wires are made of two groups with two kinds of material with identical material of microfine wires for each group but different material and number of strands among each material;

wherein material 1 of group 1 comprise 1,100 strands of 12 μm thick microfine wire, being SUS 316 or steel fiber NASLON; and material 2 of group 2 comprise 45 strands of 180 μm thick microfine wire, being a single metal of nickel and copper with a mixing ratio of 20-25% nickel by weight and 75-80% copper by weight;

wherein the strands of the two groups are bundled into one and the bundle have the resistance value per 1 m length of the thermal wire as 0.495 Ω.

29. A far-infrared radiation thermal wire comprising:

a bundle of the thermal wires which is in a parallel composite structure, where proximate multiple strands of microfine wire compile together as they emit far-infrared radiation while generating heat according to their resistance value when electricity is flowed in;

wherein the thermal wires are made of three groups with three kinds of material with identical material of microfine wires for each group but different material and number of strands among each material;

wherein material 1 of group 1 comprise 1,100 strands of 12 μm thick microfine wire, being SUS 316 or steel fiber NASLON; material 2 of group 2 comprise 9 strands of 180 μm thick microfine wire, being a single metal of nickel and copper with a mixing ratio of 20-25% nickel by weight and 75-80% copper by weight; and material 3 of group 3 comprise 2 strands of 140 μm thick microfine wire, being a single metal of copper;

wherein the strands of three groups are bundled into one and the bundle have the resistance value per 1 m length of the thermal wire as 0.314 Ω.

30. A far-infrared radiation thermal wire comprising:

a bundle of the thermal wires which is in a parallel composite structure, where proximate multiple strands of microfine wire compile together as they emit far-infrared radiation while generating heat according to their resistance value when electricity is flowed in;

wherein the thermal wires are made of three groups with three kinds of material with identical material of microfine wires for each group but different material and number of strands among each material;

wherein material 1 of group 1 comprise 1,100 strands of 12 μm thick microfine wire, being SUS 316 or steel fiber NASLON; material 2 of group 2 comprise 9 strands of 180 μm thick microfine wire, being a single metal of nickel and copper with a mixing ratio of 20-25% nickel by weight and 75-80% copper by weight; and material 3 of group 3 comprise 3 strands of 140 μm thick microfine wire, being a single metal of copper;

wherein the strands of three groups are bundled into one and the bundle have the resistance value per 1 m length of the thermal wire as 0.202Ω.

31. A far-infrared radiation thermal wire comprising:

a bundle of the thermal wires which is in a parallel composite structure, where proximate multiple strands of microfine wire compile together as they emit far-infrared radiation while generating heat according to their resistance value when electricity is flowed in;

wherein the thermal wires are made of one kind of material with identical thickness but different number of strands;

wherein material comprise 550 strands of 12 μm thick microfine wire, being SUS 316 or steel fiber NASLON;

wherein the 550 strands are bundled into one and the bundle have the resistance value per 1 m length of the thermal wire as 14 Ω.

32. A far-infrared radiation thermal wire comprising:

a bundle of the thermal wires which is in a parallel composite structure, where proximate multiple strands of microfine wire compile together as they emit far-infrared radiation while generating heat according to their resistance value when electricity is flowed in;

wherein the thermal wires are made of one kind of material with identical thickness but different number of strands;

wherein material comprise 1,100 strands of 12 μm thick microfine wire, being SUS 316 or steel fiber NASLON;

wherein the 1,100 strands are bundled into one and the bundle have the resistance value per 1 m length of the thermal wire as 7 Ω.

* * * * *